US007200468B2

(12) United States Patent
Ruhnke et al.

(10) Patent No.: US 7,200,468 B2
(45) Date of Patent: Apr. 3, 2007

(54) SYSTEM FOR DETERMINING OVERALL HEATING AND COOLING SYSTEM EFFICIENIES

(76) Inventors: John Ruhnke, 1 Thistle Rd., Norwalk, CT (US) 06851; John Distinti, 46 Rutland Ave., Fairfield, CT (US) 06825

( * ) Notice: Subject to any disclaimer, the term of this patent is extended or adjusted under 35 U.S.C. 154(b) by 38 days.

(21) Appl. No.: 11/099,236

(22) Filed: Apr. 5, 2005

(65) Prior Publication Data

US 2005/0222715 A1 Oct. 6, 2005

Related U.S. Application Data

(60) Provisional application No. 60/559,636, filed on Apr. 5, 2004.

(51) Int. Cl.
*G05D 23/00* (2006.01)

(52) U.S. Cl. ..... 700/300; 700/299; 702/130

(58) Field of Classification Search ..... 700/28, 700/299–300; 702/61, 130, 136, 182, 183; 703/1, 6

See application file for complete search history.

(56) References Cited

U.S. PATENT DOCUMENTS 3,918,300 A 11/1975 Weisstuch
4,334,275 A * 6/1982 Levine ..... 702/61
4,423,487 A 12/1983 Buckenham
4,685,615 A * 8/1987 Hart ..... 236/94
5,197,666 A * 3/1993 Wedekind ..... 236/46 R
5,717,609 A * 2/1998 Packa et al. ..... 702/130
5,983,010 A * 11/1999 Murdock et al. ..... 703/6
6,134,511 A * 10/2000 Subbarao ..... 703/6
6,478,233 B1 * 11/2002 Shah ..... 236/46 R
6,522,994 B1 2/2003 Lang
6,691,054 B1 2/2004 Lang
7,072,727 B1 * 7/2006 Davis ..... 700/97
2001/0020219 A1 9/2001 Kishlock

OTHER PUBLICATIONS

Krarti, Moncef—"Energy Audit of Building Systems"—2000, CRC Press LLC. ISBN 0-8493-95870-9.*

* cited by examiner

*Primary Examiner*—Leo Picard
*Assistant Examiner*—Alexander Kosowski
(74) *Attorney, Agent, or Firm*—Michael A. Blake

(57) ABSTRACT

A computer readable medium with instructions stored on the medium. When the instructions are executed by a processor, they cause the processor to calculate overall efficiency. A system for determining the overall efficiency for a building. The system comprises: an environment system controller with a processor used to calculate overall efficiency; a plurality of indoor temperature sensors in communication with the environment system controller; an outdoor temperature sensor in communication with the environment system controller; an efficiency monitoring device in communication with the environment system controller; and a chronograph configured to time stamp sensor readings.

15 Claims, 5 Drawing Sheets

SYSTEM FOR DETERMINING OVERALL HEATING AND COOLING SYSTEM EFFICIENIES

CROSS-REFERENCES

The present application claims the benefit of provisional patent application No. 60/559,636, filed on Apr. 5, 2004 by John Ruhnke and Robert Distinti.

TECHNICAL FIELD

The present invention is directed generally to a system and method for calculating changes in the energy efficiency of heating and cooling systems in residential and commercial buildings.

BACKGROUND

The cornerstone of an effective energy conservation program is the ability of the individual consumer to get a clear signal of the results of their energy conservation efforts and investments. For the vast majority of consumers, the only real measuring tool that signals the effect of their conservation efforts is their monthly utility bill. Their bill does not provide a clear signal due to changes in the weather and volatility in energy prices. Without clear feedback, consumers become less interested in attempting to control their energy usage, believing they have no control over their energy bill.

Only the largest consumers have been able to get a true understanding of the benefits of their conservation efforts through labor-intensive energy audits performed on a manual basis. Because of the high cost of these individual audits, it is not cost effective to perform them for retail consumers such as residential or small- to medium-sized commercial customers. The high cost of individual audits is driven by the need to manually process usage and weather data, individually deal with data deficiencies and to make manual adjustments for incomplete or inaccurate information. In manual audits, model selection occurs at the discretion of a human auditor, although there have been some attempts at automated model generation, such as the Prism approach, described in Fels, M., "PRISM: An Introduction", Energy and Buildings, 9 (1986), pp. 5–18.

Utilities may develop a prediction of a consumer's usage at "normal" weather. Typically they do so by developing a linear fit between usage and weather and applying that fitted model to normalized weather. Those equations could be used in theory to calculate individual changes in energy efficiency. However, the accuracy of this method is not sufficient for these calculations. The Prism approach attempts to overcome this deficiency by the inclusion of a household specific variable tau. However, the Prism model effectively forces all households into the same equation structure of a linear regression. Prism also calculates a normal annual consumption in its determination of efficiency, and does not use the current weather condition to determine efficiency at that weather condition. The Prism approach develops a baseline and a non-baseline model for each consumer and exercises both models on normalized weather. The Prism approach is thus subject to numerous shortcomings including model inaccuracy far exceeding the change in normal consumption and errors caused by non-constant period lengths that can obscure the changes in efficiency.

Therefore, a system and method of determining the overall efficiency of a heating system and a cooling system for a building that overcomes the above listed shortcomings is needed.

SUMMARY

The disclosed system relates to a computer readable medium with instructions stored on the medium. When the instructions are executed by a processor, they cause the processor to calculate overall efficiency.

The disclosed system also relates to a system for determining the overall efficiency for a building. The system comprises: an environment system controller with a processor used to calculate overall efficiency; a plurality of indoor temperature sensors in communication with the environment system controller; an outdoor temperature sensor in communication with the environment system controller; an efficiency monitoring device in communication with the environment system controller; and a chronograph configured to time stamp sensor readings.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
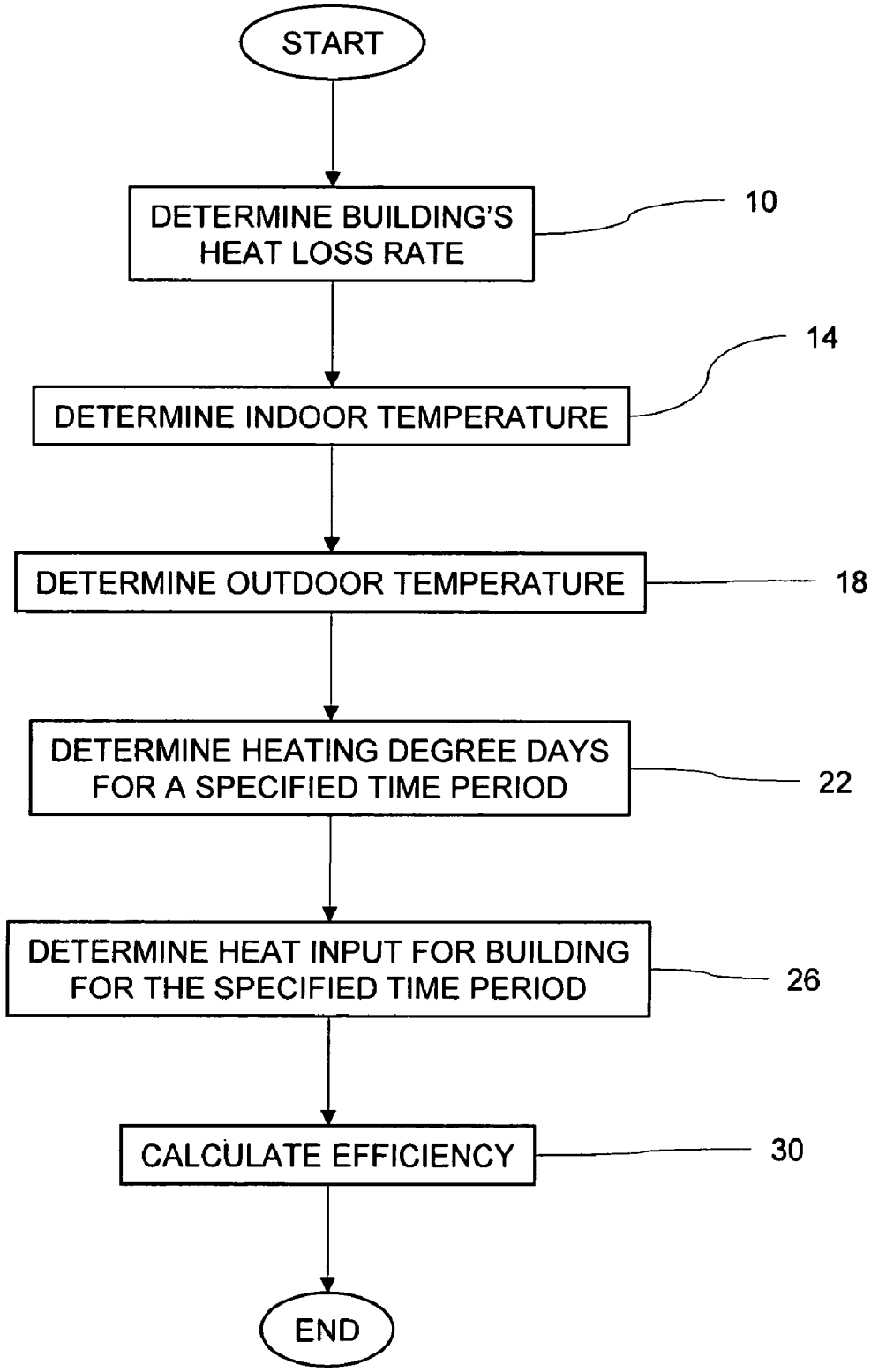
FIG. 1 is a flowchart showing a disclosed method.

FIG. 1 is a flowchart representing a disclosed method. At act 10 a building's heat loss rate is determined. Act 10 will be further discussed with respect to FIG. 2. At act 14, the indoor temperature of the building is determined. This may be done using one or more temperature transducers placed in the building. At act 18, the outdoor temperature is determined. The outdoor temperature may be obtained by using an outdoor temperature transducer. In another embodiment of the disclosed method, the indoor and outdoor temperatures may be the design indoor temperature and design outdoor temperature for the building's heating system and/or cooling system. The term environmental control unit shall mean either a building's heating system and/or cooling system. At act 22 the heating degree days for a specified time period is determined. To calculate the heating degree days for a particular day, the day's average temperature is found by adding the day's high and low temperatures and dividing by two. If the number is above a reference temperature, often 65° F., then there are no heating degree days that day. If the number is less than a reference temperature, often 65° F., subtract it from 65° F. to find the number of heating degree days. Additionally, if the method disclosed in FIG. 1 is modified for calculating the efficiency of a cooling system, cooling degree days will be determined at act 22. Cooling degree days are also based on the day's average minus a reference temperature, often 65° F. They relate the day's temperature to the energy demands of air conditioning. For example, if the day's high is 90 and the day's low is 70, the day's average is 80. 80 minus 65 is 15 cooling degree days.

In another embodiment, heating degree days may be calculated by obtaining the average temperature of the day, and subtracting the average from a reference temperature. The average temperature of the day may be weighted according to the length of time the temperature remains at a discrete point during the day. Act 22 will be discussed further with respect to FIG. 3. At act 26, the heat input for the building is determined for the same specified time from act 22. Act 26 will be further discussed with respect to FIG. 4. At act 30, the overall efficiency is calculated. The overall efficiency may be calculated using the following equation:

$$OVERALLEFFICIENCY = \frac{\frac{Q_{loss}}{t}}{T_I - T_O} \times \frac{HDD \times \frac{24\text{ hours}}{1\text{ day}}}{Q_{in}} \qquad \text{eq. 1}$$

where $Q_{loss}$ is the building heat loss in BTUs;

t is time, in hours;

$T_I$ is the inside temperature, which may be a design temperature, or actual temperature;

$T_O$ is the outside temperature, which may be a design temperature, or actual temperature;

HDD is heating degree days for a specified time period;

$Q_{in}$ is the energy put into the building, in BTUs for the specified time period; and 24 hours/1 day is a conversion factor to cancel out the hour unit from the term t.

It should be noted that $Q_{loss}$/t divided by (T1−T2) can be described as the Ua. Building heat loss may be characterized in terms of conduction and air infiltration losses. Conduction losses are the total heat transmitted through the walls, windows, floors and ceilings. This heat loss is commonly referred to as the building's Ua. Building Ua is determined by summing up the product of individual components' U-value heat loss coefficients and corresponding surface areas.

A few examples showing how the OVERALL EFFICIENCY equation may be used. In the first example, "Home A" with a standard boiler and baseboard heat is upgraded to a more advanced boiler with outdoor reset capabilities. Some of the baseboard heat is replaced with radiant heating. The data taken before the upgrade is: Heat loss of structure A=75000 BTU/hr @ 70 degrees; HDD (Heating Degree Days)=3020 degree*days; Fuel usage in BTU (calculated from fuel bills)=1135 CCF @ 100,000 BTU per ccf=113,500,000 BTU. The time period used to calculate the heating degree days and fuel usage was 83 days. Therefore, OVERALL EFFICIENCY is thereby calculated to be:

OVERALL EFFICIENCY=75,000/(70−0)×3020×24/113,500,000=0.684 or 68.4%.

After a new boiler and heating system changes were installed, the tests results were: Heat loss of structure=75,000 BTU/hr @ 70 degrees; HDD (Heating Degree Days)=3086 degree*days; fuel usage in BTU (calculated from fuel bills)=937 CCF @ 100,000 BTU per ccf=93,750,000 BTUs. The time period used to calculate the heating degree days and fuel usage was 89 days. Thus the new OVERALL EFFICIENCY is calculated as:

OVERALL EFFICIENCY=75,000/(70−0)×3086×24/93,750,000=0.846 or 84.6%.

Thus it can be seen that there was a 16.2% increase in OVERALL EFFICIENCY after the new boiler was installed and heating system changes were made.

A second example is now discussed. The Heat loss of structure was determined to be 25,500 BTU/hr @ 70 degrees. The HDD was 3142 degree*days. Fuel usage was 320 gal @ 138,500 BTU per gal, which is 44,320,000 BTUs. Applying equation 1:

OVERALL EFFICIENCY=25,500/(70−0)×3142×24/44,320,000=0.620 or 62%.

Thus, a heating or air conditioning contractor or home user could use the overall efficiency to measure the efficiency of his heating or air conditioning installation. The overall efficiency allows for comparison of different heating and cooling system designs. The user can therefore determine whether hot air more efficient then radiant heat, or what the effect of different size boilers are on overall efficiency, and how installation piping wire methods affect the efficiency of a heating or cooling system. This sort of comparison of overall efficiency allows for future improvements of heating and air conditioning systems.

Figure 2:
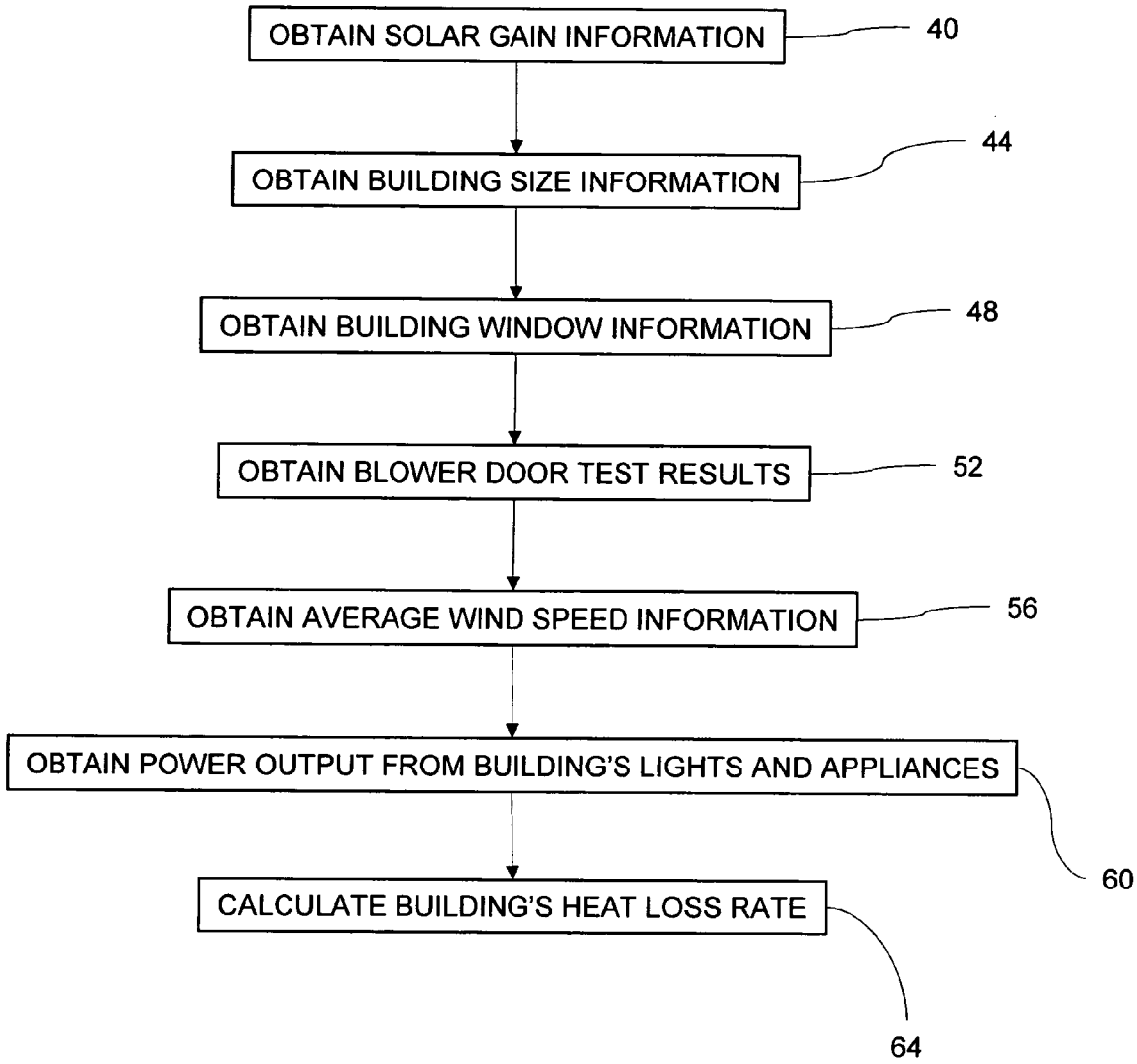
FIG. 2 is a flowchart showing a disclosed method.

FIG. 2 shows a flowchart representing a method of determining a building's heat loss rate (act 10 from FIG. 1). At act 40, the solar gain for the building is obtained. Solar gain is heat gain into a building form the solar radiation through glass of different types and interior shading. Solar gain is called "radiation gain". At act 44 the building's size and other information is obtained. Other information may include number of rooms, number and size of doors, number of bathrooms, number of appliances, etc. At act 48 the building's window information is obtained. Information may include window area, window heat loss and solar gain. At act 52, blower door test results are obtained. The standard blower door test is a depressurization test. This means that air will be blown out from the building, creating a negative pressure in the building. At act 56 the average wind speed information is obtained. At act 60, the power output from the buildings lights and appliances are obtained. At act 64, the buildings heat loss rate is calculated. The heat loss rate may be calculated for one or more discrete time period(s), or the heat loss rate may be continually calculated to give an instant heat loss rate for the building.

Figure 3:
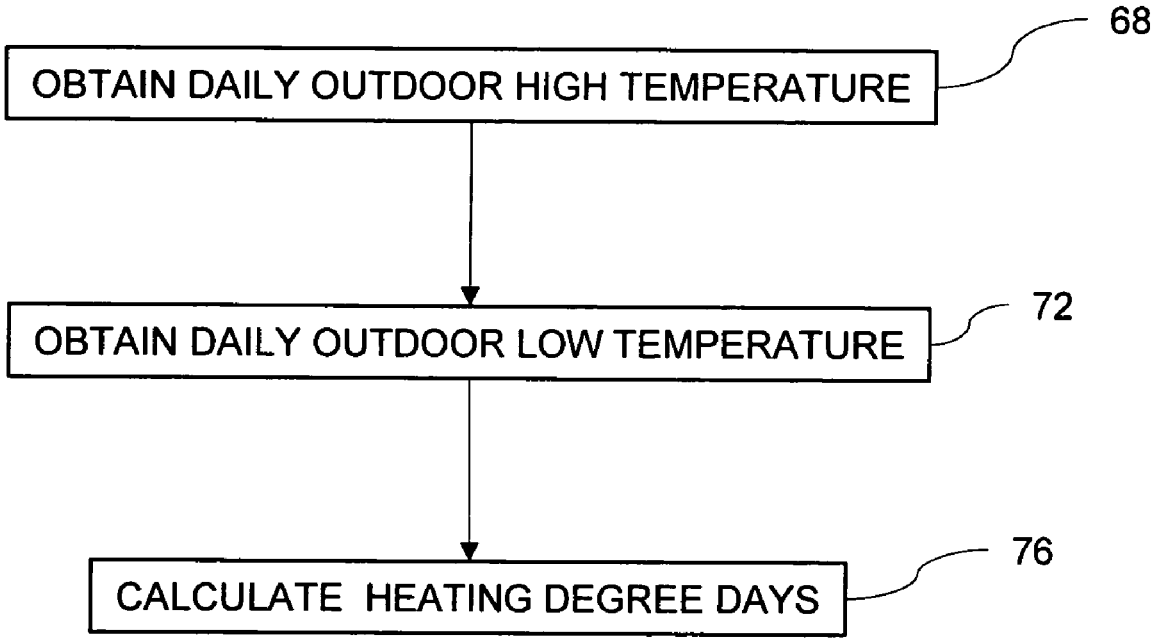
FIG. 3 is a flowchart showing a disclosed method.

FIG. 3 is a flowchart representing a method of determining the heating degree days that the building is subject to (act 22 of FIG. 1). At act 68, the daily outdoor high temperature is obtained. At act 72 the daily outdoor low temperature is obtained. At act 76 the heating degree days is calculated. The heating degree days may be calculated for one or more discrete time period(s).

Figure 4:
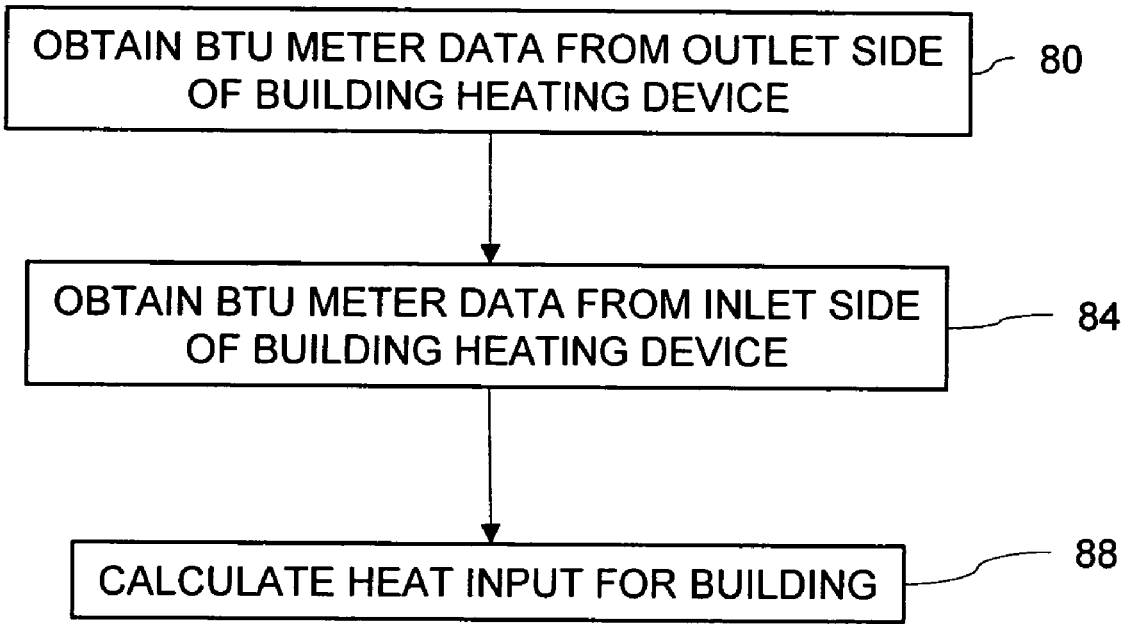
FIG. 4 is a flowchart showing a disclosed method.

FIG. 4 is a flowchart representing a method of determining the heat input for a building (act 26 of FIG. 1). At act 80, BTU meter data from an outlet side of a building heating device is obtained. At act 84, BTU meter data from an inlet side of the building heating device is obtained. At act 88, the heat input for the building is determined. The heat input for the building may be determined for one or more discrete time period(s), or the heat input may be continually calculated to give an instant heat input for the building. In another embodiment, heat input for a building may be determined by calculating the fuel usage at a environmental controller using a flow meter.

Figure 5:
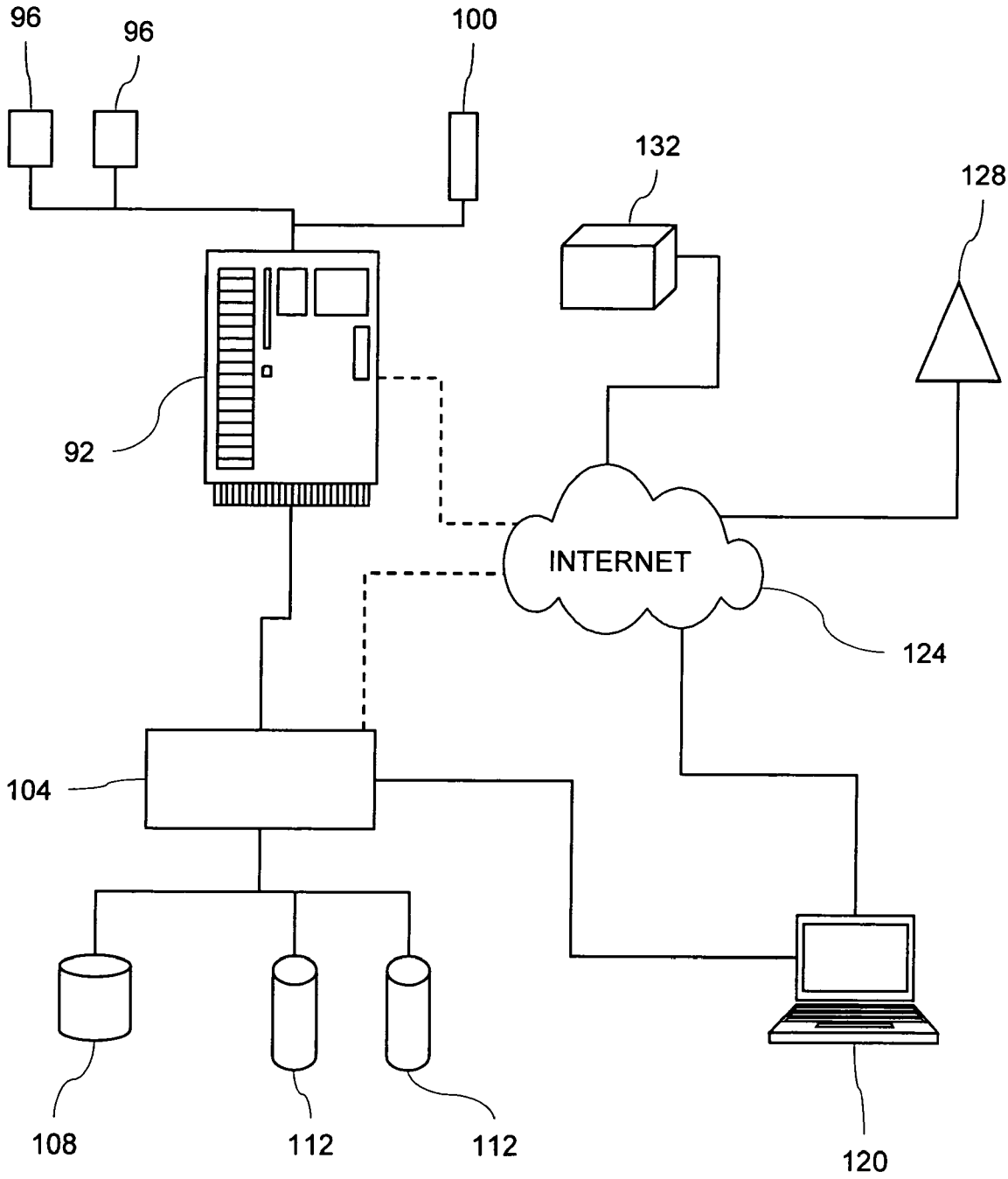
FIG. 5 is a schematic diagram showing a disclosed system.

FIG. 5 is a schematic representing a disclosed system. A building environment system controller 92 is in communication with a plurality of indoor temperature sensors 96, and at least one outdoor temperature sensor 100. The controller 92 may be any of a variety of known heating system controllers or cooling system controllers, including a Tekmar boiler controller. The controller 92 is in communication with an efficiency monitoring device 104. The efficiency monitoring device 104 is in communication with a flow meter 108 and at least one BTU meter 112. In other embodiments, the efficiency monitoring device may be in communication with both an inlet BTU meter 112 and an out BTU meter. The BTU meter may be used to determine the heat input for a building. The heat input may be compared with the heat loss. If the heat input and heat loss are roughly equal, one may have good confidence in one's readings. In an embodiment, device 104 may comprise a chronograph to time and/or date stamp any necessary input. In the disclosed embodiment, the efficiency monitoring device 104 is in communication with a computer 120. The computer is in communication with a network, such as the internet 124. Via the internet 124, the computer 120 is in communication with a weather tracking center 128. The weather tracking center 128 may provide information wind, temperature and solar sensors in the general vicinity of the building. The computer 120 has computer readable medium with instructions stored thereon which when executed by a processor, cause the processor to calculate the overall efficiency of the building. The computer 120 may be in communication with database 132. The database 132 may store information on overall efficiencies for various types of buildings, heating systems, cooling systems, etc., in order to compare the overall efficiencies of various types of heating systems, cooling systems and buildings. In another embodiment, the efficiency monitoring device 104 may be in direct communication with a network, such as the internet 124. Via the internet 124, the efficiency computing may have access to the weather tracking center 128. Further, in this embodiment, the efficiency monitoring device 104 may have a processor and a computer readable medium with instructions stored thereon which when executed by the processor, cause the processor to calculate the overall efficiency of the building. The overall efficiency and other data may be communicated to the database 132 via the internet 124. The efficiency monitoring device 104 may have a display to indicate to a user the current overall efficiency of the building.

Using the present invention retail consumers can see the results of their behavioral changes such as resetting their thermostats, purchasing more energy efficient products such as radiant heat flooring, sub-compact fluorescent light bulbs, high efficiency heating and cooling units and EnergyStar RTM compliant electronics and home-improvement projects such as installing additional insulation, stopping air leaks and installing storm doors and windows. Retail consumers will enjoy the same benefits currently available only to large commercial, governmental and industrial consumers through expensive, labor-intensive processes.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A first enviromental control unit comprising a computer readable medium having instructions stored thereon which when executed by a processor, cause the processor to calculate an overall efficiency that is proportional to the ratio of a first building's heat loss divided by the energy inputted into the first building, and where the overall efficiency can be used as a comparison against an overall efficiency of a second building with a second environmental control unit, and wherein the instructions stored thereon further cause the processor to:

solve the equation $$OVERALLEFFICIENCY = \frac{\frac{Q_{loss}}{t}}{T_I - T_O} \times \frac{HDD \times \frac{24\text{ hours}}{1\text{ day}}}{Q_{in}}$$

for the term OVERALL EFFICIENCY, wherein $Q_{loss}$ is the building heat loss in BTUs;

t is time, in hours;

$T_I$ is the inside temperature;

$T_O$ is the outside temperature;

HDD is heating degree days for a specified time period;

$Q_{in}$ is the energy put into the building, in BTUs for the specified time period; and 24 hours/1 day is a conversion factor to cancel out the hour unit from the term t.

2. The first environmental control unit of claim 1, wherein the computer readable medium having instructions stored thereon further cause the processor to:

determine a building's heat loss rate;

determine an indoor temperature;

determine an outdoor temperature;

determine heating degree days for a specified time period;

determine a heat input for a building for the specified time period; and calculate an overall efficiency.

3. The first environmental control unit of claim 1, wherein the computer readable medium having instructions stored thereon further cause the processor to:

obtain building size information;

obtain building window information;

calculate a heat loss rate for the building.

4. The first environmental control unit of claim 1, wherein the computer readable medium having instructions stored thereon further cause the processor to:

obtain solar gain information.

5. The first environmental control unit of claim 1, wherein the computer readable medium having instructions stored thereon further cause the processor to:

obtain average wind speed information.

6. The first environmental control unit of claim 1, wherein the computer readable medium having instructions stored thereon further cause the processor to:

obtain power output from building lights and appliances.

7. The first environmental control unit of claim 1, wherein the computer readable medium having instructions stored thereon further cause the processor to:

obtain the daily average outdoor temperature; and calculate a heating degree day value for a specified time period.

8. The first environmental control unit of claim 1, wherein the computer readable medium having instructions stored thereon further cause the processor to:

obtain BTU meter data from an outlet side of a building heating system;

obtain BTU meter data from an inlet side of the building heating system; and calculate a heat output value for the building for a specified time period.

9. A system for determining overall efficiency for a first building, the system Comprising:

a first-environment system controller with a processor and a computer readable medium having instructions stored thereon which when executed by a processor, cause the processor to calculate an overall efficiency that is proportional to the ratio of the first building's heat loss divided by the energy inputted into the first building, and where the overall efficiency can be used as a comparison against an overall efficiency of a second building with a second environment system controller, and wherein the instructions stored thereon further cause the processor to:

solve the equation $$\text{OVERALL EFFICIENCY} = \frac{\frac{Q_{loss}}{t}}{T_i - T_o} \times \frac{HDD \times \frac{24\text{ hours}}{1\text{ day}}}{Q_{in}}$$

for the term OVERALL EFFICIENCY, wherein $Q_{loss}$ is the building heat loss in BTUs;

t is time, in hours;

$T_I$ is the inside temperature;

$T_O$ is the outside temperature;

HDD is heating degree days for a specified time period;

$Q_{in}$ is the energy put into the building, in BTUs for the specified time period; and 24 hours/1 day is a conversion factor to cancel out the hour unit from the term t;

a plurality of indoor temperature sensors in communication with the first environment system controller;

an outdoor temperature sensor in communication with the first environment system controller;

an efficiency monitoring device in communication with the first environment system controller; and a chronograph configured to time stamp sensor readings.

10. The system of claim 9, further comprising:

a flow meter in communication with the efficiency monitoring device.

11. The system of claim 9, further comprising:

a BTU meter in communication with the efficiency monitoring device.

12. The system of claim 9, further comprising:

a network in communication with the efficiency monitoring device;

a weather tracking center in communication with the efficiency monitoring device via the network.

13. The system of claim 12, further comprising:

a database in communication with the efficiency monitoring device via the network.

14. The system of claim 9, further comprising:

a computer in communication with the efficiency monitoring device;

a network in communication with the computer;

a weather tracking center in communication with the computer via the network.

15. The system of claim 14, further comprising:

a database in communication with the computer via the network.

* * * * *